United States Patent [19]

Kanfer

[11] Patent Number: 4,621,749

[45] Date of Patent: Nov. 11, 1986

[54] DISPENSING APPARATUS

[75] Inventor: Joseph S. Kanfer, Akron, Ohio

[73] Assignee: Go-Jo Industries, Cuyahoga Falls, Ohio

[21] Appl. No.: 581,693

[22] Filed: Feb. 21, 1984

[51] Int. Cl.[4] ..... B67D 5/42

[52] U.S. Cl. ..... 222/153; 222/181; 222/183; 222/214; 222/383

[58] Field of Search ..... 222/95, 105, 131, 135, 222/144.5, 181, 183–185, 214, 207, 209, 383, 380, 153; 292/101, 145; 312/215

[56] References Cited

U.S. PATENT DOCUMENTS

| | | | |
|---|---|---|---|
| 2,660,395 | 11/1953 | Mair et al. | 251/5 |
| 2,772,817 | 12/1956 | Jauch | 222/207 |
| 2,993,626 | 7/1961 | Gildersleeve | 222/214 |
| 3,081,911 | 3/1963 | Scholle | 222/107 |
| 3,089,622 | 5/1963 | Westlake, Jr. | 222/183 |
| 3,117,695 | 1/1964 | Cox, Jr. | 222/105 |
| 3,232,496 | 2/1966 | Rockwell, Jr. et al. | 222/309 |
| 3,741,439 | 6/1973 | Vehrs | 222/103 |
| 3,768,704 | 10/1973 | Beguin | 222/207 |
| 3,870,201 | 3/1975 | Asplund | 222/207 |
| 4,018,363 | 4/1977 | Cassia | 222/80 |
| 4,130,224 | 12/1978 | Norman et al. | 222/185 |
| 4,238,056 | 12/1980 | Tucker et al. | 222/181 |
| 4,256,242 | 3/1981 | Christine | 222/207 |
| 4,349,133 | 9/1982 | Christine | 222/183 |
| 4,391,308 | 7/1983 | Steiner | 141/18 |
| 4,391,309 | 7/1983 | Steiner | 141/18 |
| 4,394,938 | 7/1983 | Frassanito | 222/207 |

FOREIGN PATENT DOCUMENTS

| | | | |
|---|---|---|---|
| 2524624 | 12/1975 | Fed. Rep. of Germany | 222/185 |
| 3024409 | 3/1982 | Fed. Rep. of Germany | 222/207 |

*Primary Examiner*—Charles A. Marmor
*Attorney, Agent, or Firm*—Reese Taylor

[57] ABSTRACT

A dispenser for dispensing viscous material from a container having an elongate, flexible dispensing tube includes a back plate for wall mounting and a cover, hingedly connected to said back plate and movable between open and closed positions with respect thereto. A normally concealed but accessible latch mechanism is carried by the back plate and the cover for releasably securing the cover in its closed position. The back plate has an integral seat for reception of the container and a tube receiving member for seating and locating the tube which extends from the container. A dispensing bar is hingedly mounted on the back plate and carries a resiliently mounted pressure member. The dispensing bar and pressure member are normally urged into engagement with the tube and toward the back plate when the tube is held in the tube receiving member and are further movable into collapsing relationship with the tube upon the application of hand pressure to the dispensing bar. The cover has a through opening in its front wall whereby the dispensing bar is accessible when the cover is in closed position. The cover also has a through opening in its bottom wall so that the end of the tube may be projected therethrough whereby the material being dispensed can be dispensed into the hand of the user upon application of pressure to the dispensing bar.

17 Claims, 11 Drawing Figures

DISPENSING APPARATUS

FIELD OF THE INVENTION

This invention relates, in general, to the art of dispensing materials and particularly relates to dispensing viscous or granular material from a replacable container which has a collapsible, resilient tube extending therefrom and which is receivable in the dispenser.

DESCRIPTION OF THE PRIOR ART

The general dispensing prior art is rather voluminous in terms of various types of wall mounted dispensers which are capable of dispensing various materials, such as soap or other viscous or granular material, upon application of pressure to a dispensing arm or member. The present invention is directed primarily to the dispensing of soaps or lotions onto the hand of the user although the operational features thereof would obviously not be limited to any particular material.

The art has evolved from rigid cartridges containing the soap or other material from which the soap is dispensed by various valving arrangements to, at least in some applications, collapsible containers which contain the material and which essentially consist of an inner, flexible envelope mounted in a relatively rigid, outer container, such as cardboard or paper. Examples of this art can be seen in Scholle U.S. Pat. No. 3,081,911; Westlake U.S. Pat. No. 3,089,622; and Cox U.S. Pat. No. 3,117,695.

Many of these types of containers contain or include collapsible tubes which, in conjunction with pressure members, dispense a predetermined amount of fluid upon the application of pressure to the tubes. Examples of this art may be seen Mair U.S. Pat. No. 2,660,395; Jauch U.S. Pat. No. 2,772,817; Gildersleeve U.S. Pat. 2,993,626; and Rockwell U.S. Pat. No. 3,232,496.

Furthermore, the art has developed to the point where containers for the material, which is most commonly sold in the containers with collapsible tubes of the type above-described, are combined with wall mounted dispensers which include various designs of pressure members for collapsing the tube and forcing a measured amount of material onto the hand of the user. Examples of this art may be seen in Vehrs U.S. Pat. No. 3,741,439; Beguin U.S. Pat. No. 3,768,704; Asplund U.S. Pat. No. 3,870,201; Cassia U.S. Pat. No. 4,018,363; Norman U.S. Pat. No. 4,130,224; Christine U.S. Pat. No. 4,256,242; Christine U.S. Pat. No. 4,349,133; Steiner U.S. Pat. No. 4,391,308; Steiner U.S. Pat. No. 4,391,309; and Frassanito U.S. Pat. No. 4,394,938.

The basic operation and structure of these various prior art developments are, at least generically, similar in that they provide means for supporting the soap container within the dispenser, provide means for applying pressure to the tube to force the material out the end of the tube and into the hand of the user, and provide a cover which can be moved between open and closed positions for replacement of the material container. While apparently operative, many of these structures, however, are overly complicated and subject to wear and failure.

BRIEF DESCRIPTION OF THE INVENTION

Accordingly, the principal objects of this invention are to provide a dispenser which will securely hold the soap container, readily engage the tube, make it easy to apply pressure toward the back plate, provide ready access to the dispenser interior, and securely lock the cover in place.

It has been discovered that the principal objects of this invention can be achieved by providing a relatively simple, yet effective, dispenser which includes a back plate and a cover hingedly connected thereto and movable between open and closed positions with normally concealed, but readily accessible, latch means for securing the cover in the closed position. This arrangement makes replacement of the material container relatively easy while reducing the problem of vandalism.

It has also been found that by hingedly mounting the dispensing bar or pressure member within the dispenser, it is possible to easily load the material container and locate the dispensing tube, thereby avoiding some difficulties with the prior art in properly locating the tube within the dispenser.

It has also been found that the cover can be so designed that the dispensing bar is readily accessible once the cover is closed and, further, that mounting the dispensing bar so that the dispensing motion is toward the back plate enhances the permanence of the mounting of the dispenser.

Accordingly, production of an improved dispensing apparatus of the type above-described becomes the principal object of this invention with other objects thereof becoming more apparent upon a reading of the following brief specification considered and interpreted in view of the accompanying drawings.

OF THE DRAWINGS

BRIEF DESCRIPTION OF THE PREFERRED EMBODIMENTS

Figure 1:
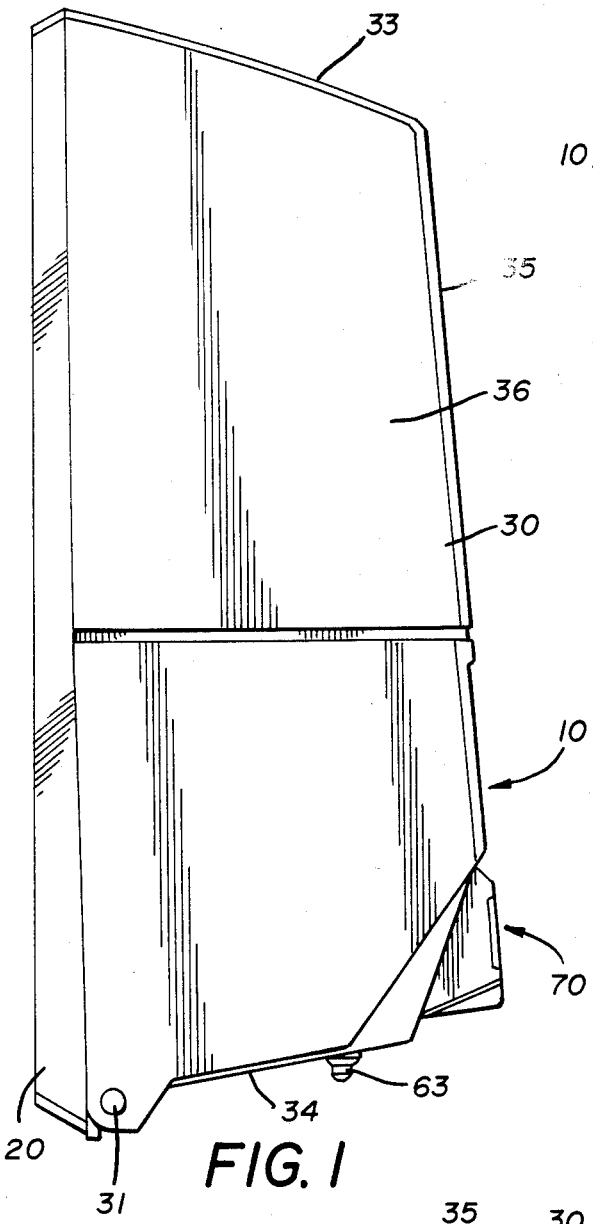
FIG. 1 is a side elevational view of the improved dispenser.
Figure 2:
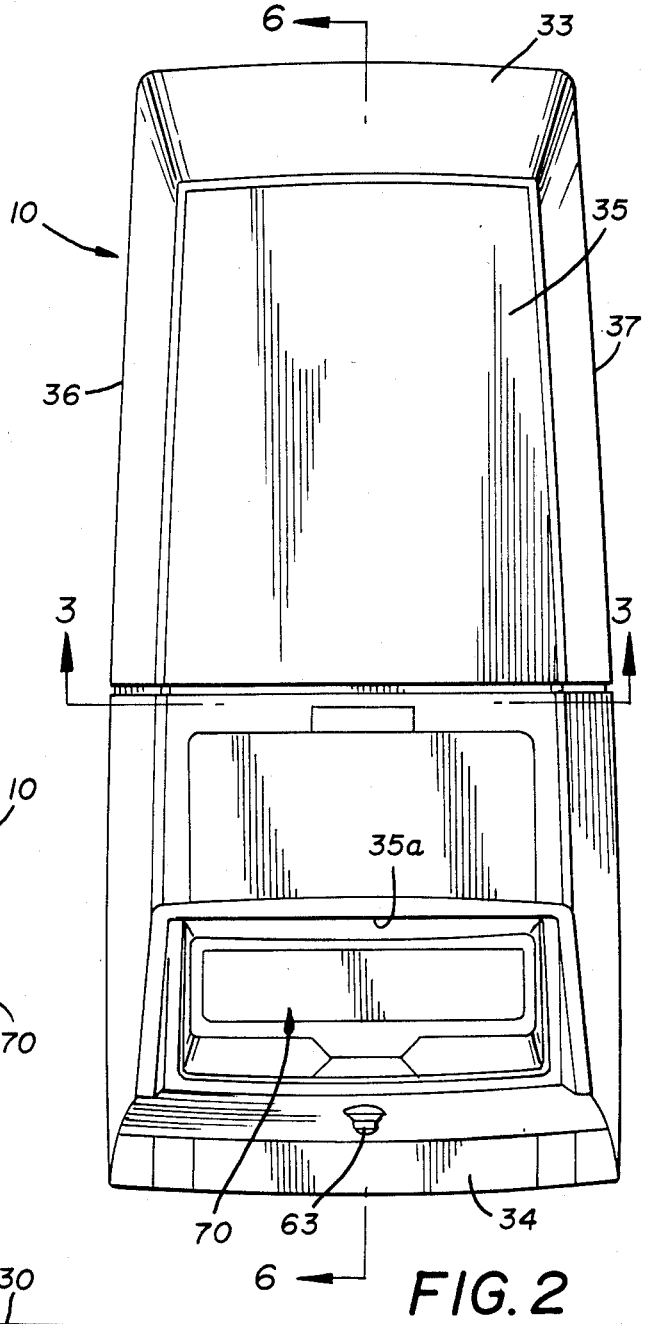
FIG. 2 is a front elevational view thereof.
Figure 3:
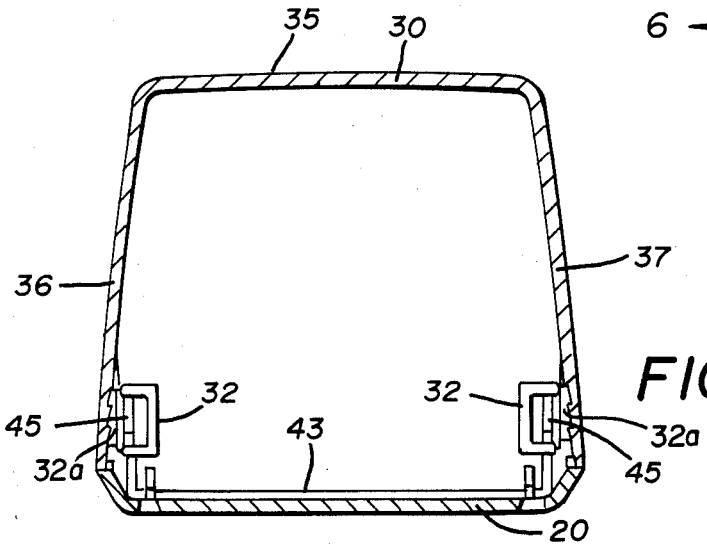
FIG. 3 is a sectional view taken along the line 3—3 of FIG. 2.

Referring to FIGS. 1 and 2, it will be seen that the improved dispenser, generally indicated by the numeral 10, includes, as its basic components, a back plate 20 and a front cover 30. It is contemplated that these would be molded of plastic or similar material and be unitary in structure although, of course, the invention is not intended to be limited to any particular material. Nor is it intended that the front cover 30 or the back plate 20 be limited to being all of one piece of material, although it is felt that in the preferred form of the invention, from the manufacturing standpoint, this would be preferable.

Figure 5:
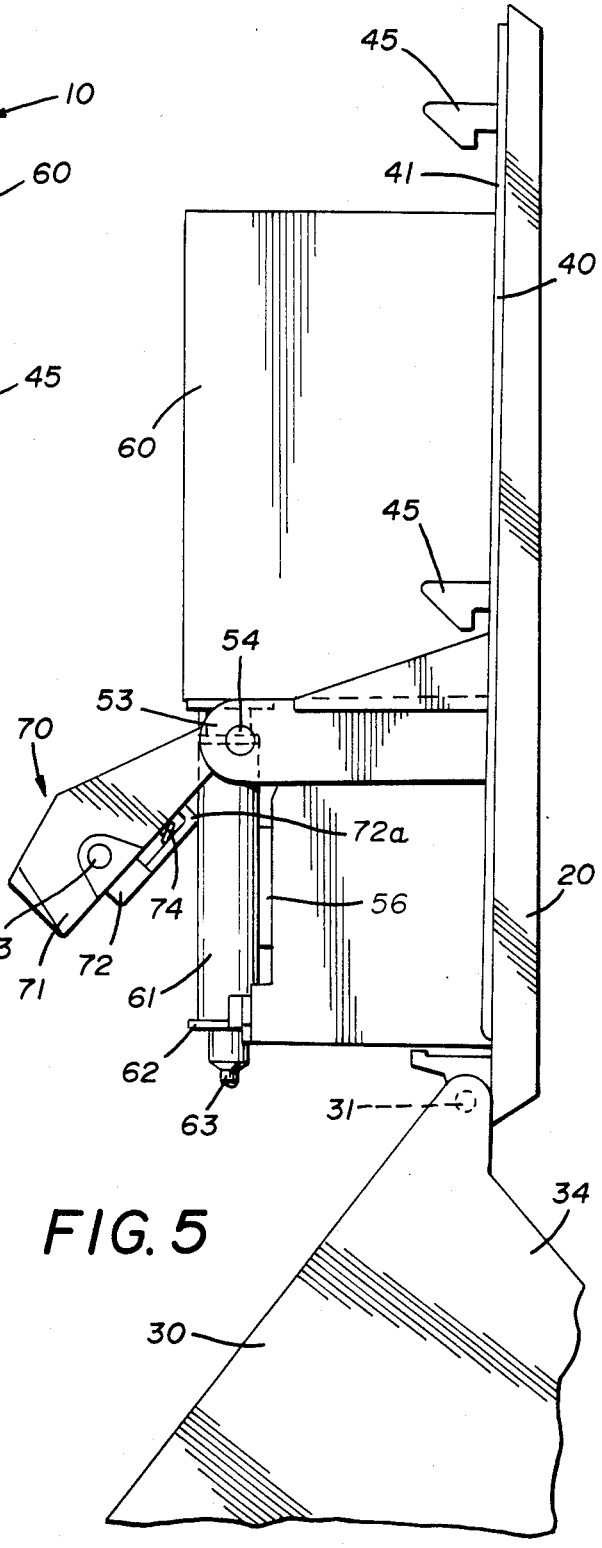
FIG. 5 is a side elevational view similar to FIG. 4 showing the cover in its open position.
Figure 6:
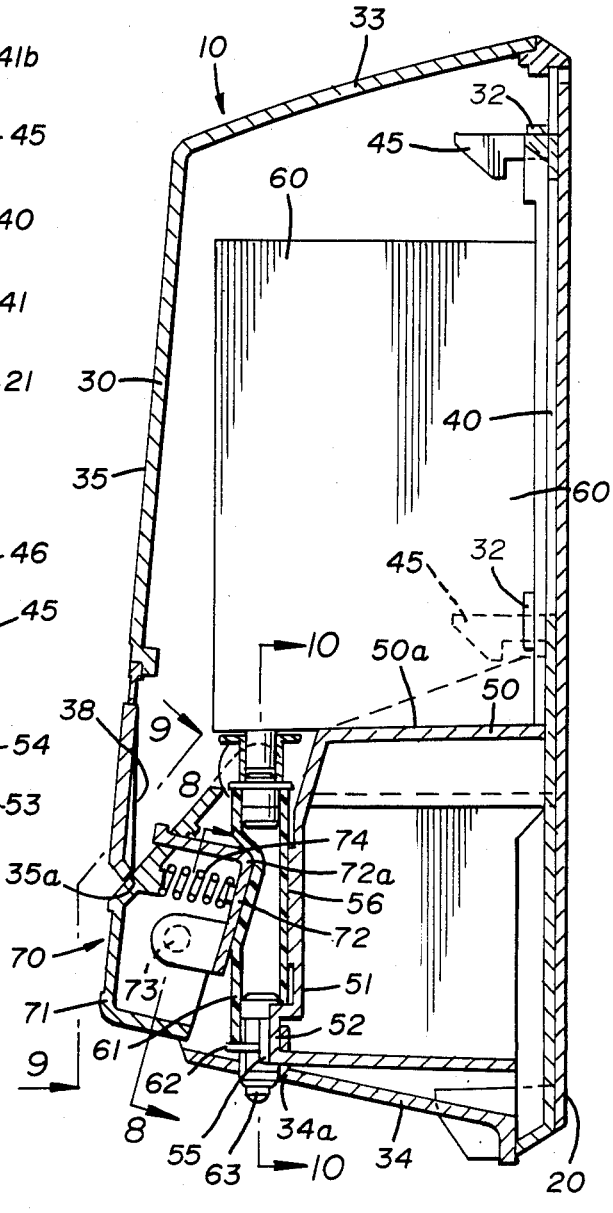
FIG. 6 is a sectional view taken along the line 6—6 of FIG. 2.
Figure 8:
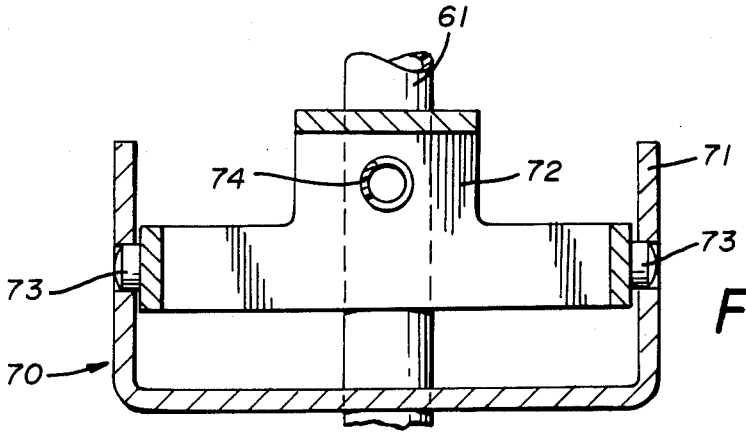
FIG. 8 is a sectional view taken along the line 8—8 of FIG. 6.
Figure 9:
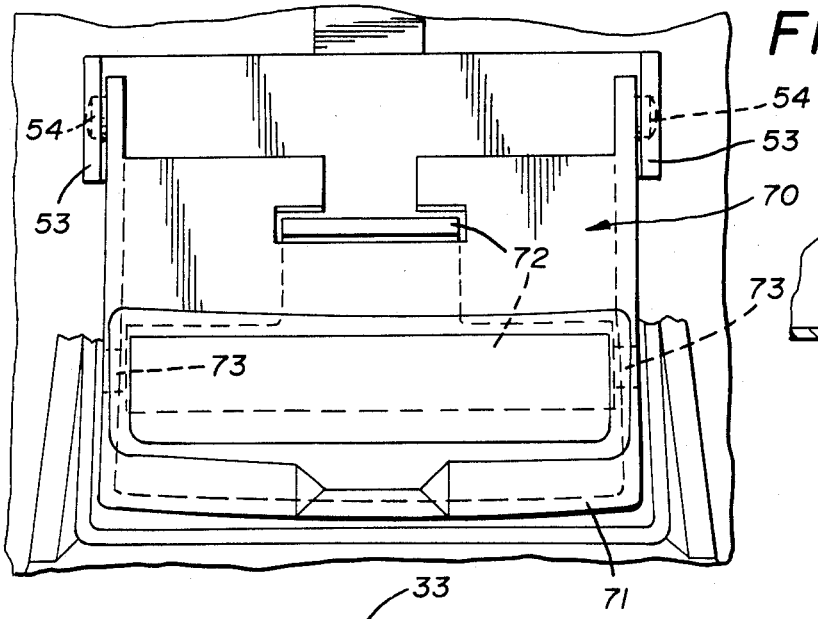
FIG. 9 is a partial, elevational view taken along the line 9—9 of FIG. 6.
Figure 10:
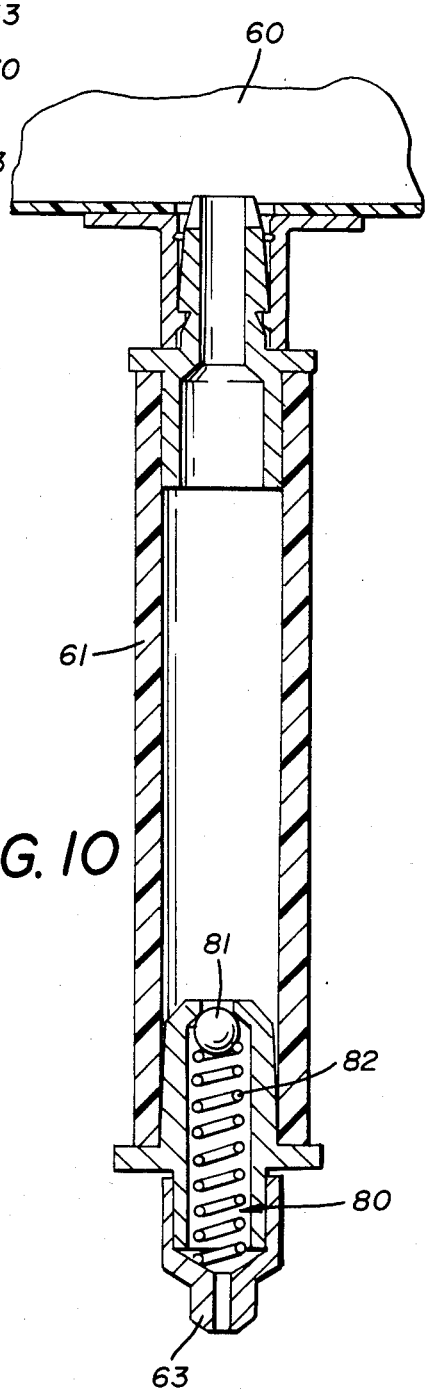
FIG. 10 is an enlarged, sectional view taken along the line 10—10 of FIG. 6 and showing the dispensing spout of the cartridge.
Figure 11:
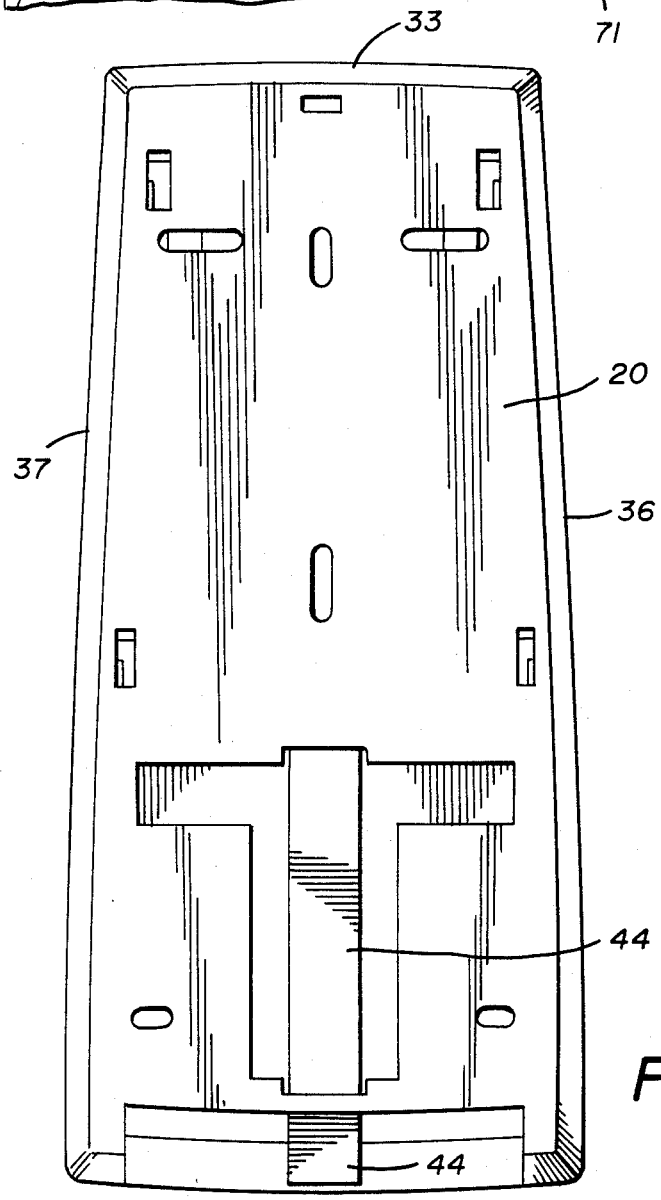
FIG. 11 is a rear elevational view of the back plate.

Still referring to FIGS. 1 and 2 and referring also to FIGS. 5 and 6, it will be noted that the front cover 30 is hinged as at 31 to the back plate 20 so as to be movable between the closed position of FIGS. 1, 2, and 6 and the open position of FIG. 5, for example.

Latch means are carried by the back plate 20 and the front cover 30 in order to securely lock the cover 30 in the closed position of FIG. 1 as will now be described.

Figure 7:
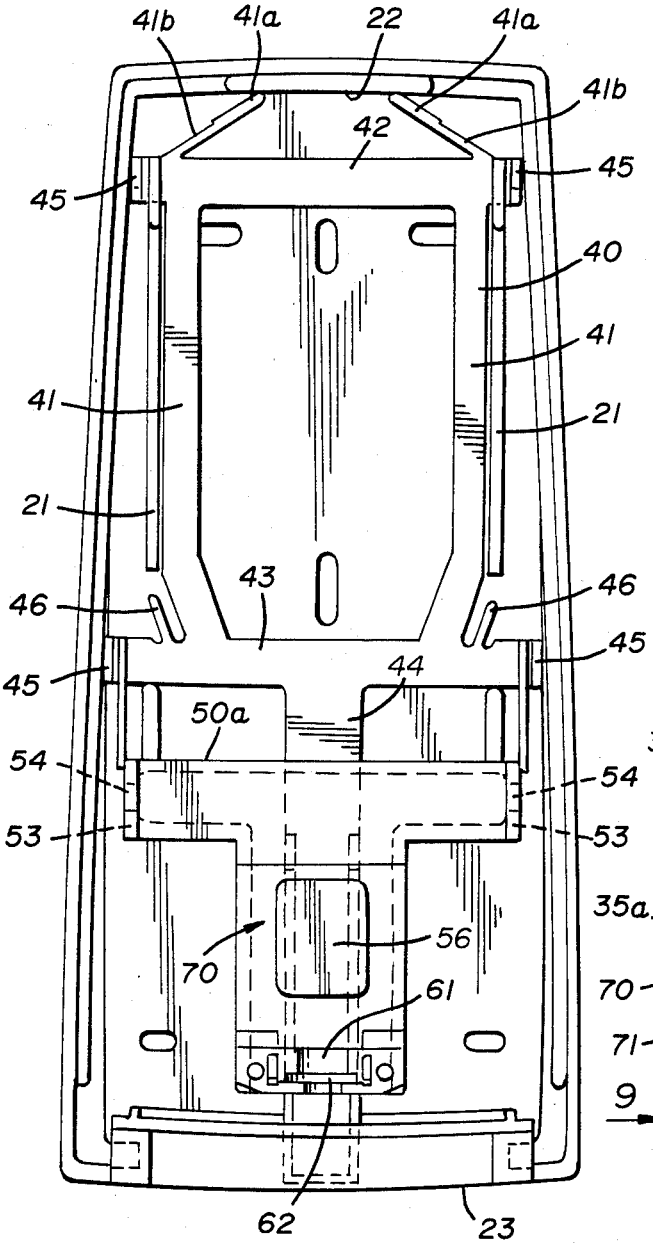
FIG. 7 is a front elevational view similar to FIG. 4 with the soap cartridge removed.

Referring to FIGS. 5, 6, and 7, it will be noted that a latch plate 40 comprises a relatively thin, flat member releasably and movably carried by the back plate 20. This latch plate includes opposed elongate side frame members 41, 41, transverse interconnecting top and bottom frame members 42 and 43, and an extension arm 44 projecting from bottom frame member 43. The extension arm 44 is of sufficient length so as to project beneath the bottom face of the closed front cover 30, as will be described.

It will also be noted that latch plate 40, which may become damaged during extended use, can be readily replaced since it merely snaps into place between rails 21,21 of back plate 20.

Projecting from the top ends of the side frame members 41,41 of latch plate 40 are angularly extending extensions 41*a*,41*a* which serve as springs and bear against the top lip 22 of the back plate. These extensions are resiliently engaged against top lip 22 so as to normally urge the latch plate 40 downwardly toward the bottom edge 23 of the back plate 20 for purposes which will be subsequently described. It will also be noted that extensions 41*a*,41*a* are relieved as at 41*b*,41*b* to permit easy compression thereof for unlatching.

Projecting upwardly from the side frame members 41,41 are a plurality of hooks 45,45. In the form of the invention illustrated herein, there are four of these essentially arranged at the four corners of the parallelogram formed by the side frame members 41,41 and the top and bottom frame members 42 and 43 (see FIGS. 6 and 7).

Removably carried on the front cover 30 are projecting clips 32,32 which form generally rectangular frames having an open center area and which are engageable with the hooks 45,45 when the latch plate 40 is urged toward the bottom of the back plate 20 by extensions 41*a*,41*a* and the cover 30 is closed, as can be seen in FIG. 6. Pressure, however, on the end of extension 44 in an upward direction will shift the latch plate 40 sufficiently in an upward direction, compressing extensions 41*a*,41*a* against the top edge 22 of backplate 20, so that hooks 45,45 clear the clips 32,32 and permit the front cover to be opened to the position of FIG. 5, pivoting around the hinge mounting point 31.

It will also be noted that bottom frame member 43 of the latch plate 40 has a pair of projections 46,46 which will engage the lower ends of rails 21,21 upon upward movement of the latch plate 40. These projections are dimensioned so as to permit sufficient movement to disengage hooks 45,45 from clips 32,32 but restrict movement so as to protect extensions 41*a*,41*a* from being compressed to the breaking point.

It should also be noted that the clips 32,32 are slip fit into channels 32*a*,32*a* in cover 30. Since there is at least a possibility that these clips could become damaged during use, such an arrangement makes it possible to easily replace them.

Referring to FIGS. 5 and 6, it will be noted that back plate 20 also includes a projecting support member 50 which is intended to receive and serve as a support for the box 60 or other container for the soap or other material being dispensed. In the form of the invention illustrated, it is contemplated that this container would simply rest on the shelf 50*a* formed by the top of the support unit 50.

The support unit 50 also has a downwardly extending forward wall 51 which terminates in a projection 52 which, in turn, receives a tube receiving fitting 55 intended to receive the fitting 62 on the extended end of the tube 61 of the soap container 60. The fitting 55 is snap fit into projection 52 and is intended to mate with a complementally contaoured fitting 62 on the tube.

Extending outwardly from the top end of shelf 50*a* are a pair of opposed ears 53,53. The dispensing assembly 70 is hingedly mounted to these ears as at 54 so that it may be swung away from support unit 50 and out of the way to facilitate loading.

The dispensing assembly 70 includes a main housing 71, the outer surface of which comprises the dispensing bar, and a pressure member 72 with the top end of housing 71 pivotally attached to the ears 53,53 as already noted.

The pressure member 72 is pivotally connected to the main housing 71 as at 73 and normally urged away from the inner surface of the housing by the spring 74. When the cover is closed, this arrangement urges the pressure member 72 into contact with the tube 61. It can, of course, however, be swung out of the way (see FIG. 5) so that when the cartridge 60 is placed in the container, the tube 61 can easily be passed between the ears 53,53 and seated in the fitting 55 of the tube receiving receptacle 52.

As noted, fitting 55 is snap fit into projection 52 and can be removed and replaced to accommodate various configurations of fitting 63 on tube 61.

It will be noted also that, with reference to FIGS. 1 and 2 of the drawings, the front cover 30 includes a forward or front wall 35 which is interconnected to top and bottom walls 33 and 34 and side walls 36 and 37.

In the lower portion of the front wall 35 of the front cover 30, there is a through aperture 35a which is dimensioned such that a portion of the body 71 of the dispensing unit 70 is freely accessible therethrough to thus constitute the dispensing bar. The bottom wall 34 also has a through aperture 34*a* through which the distal end of the tube 61 may be received.

Finally, it will be noted that cam surfaces 38,38 are molded into the inner surface of cover 30 so as to facilitate closing of the cover when the container is in place, as will be discussed below.

In operation, and assuming back plate 20 to be mounted on a wall or other vertical surface by screws, adhesive, or other suitable means, cover 30 can be opened by pushing upwardly on extension arm 44 to release the latch. It should be noted that extension 44 is readily accessible for this purpose, but not readily visible, thereby reducing vandalism (see, for example, FIG. 2).

Figure 4:
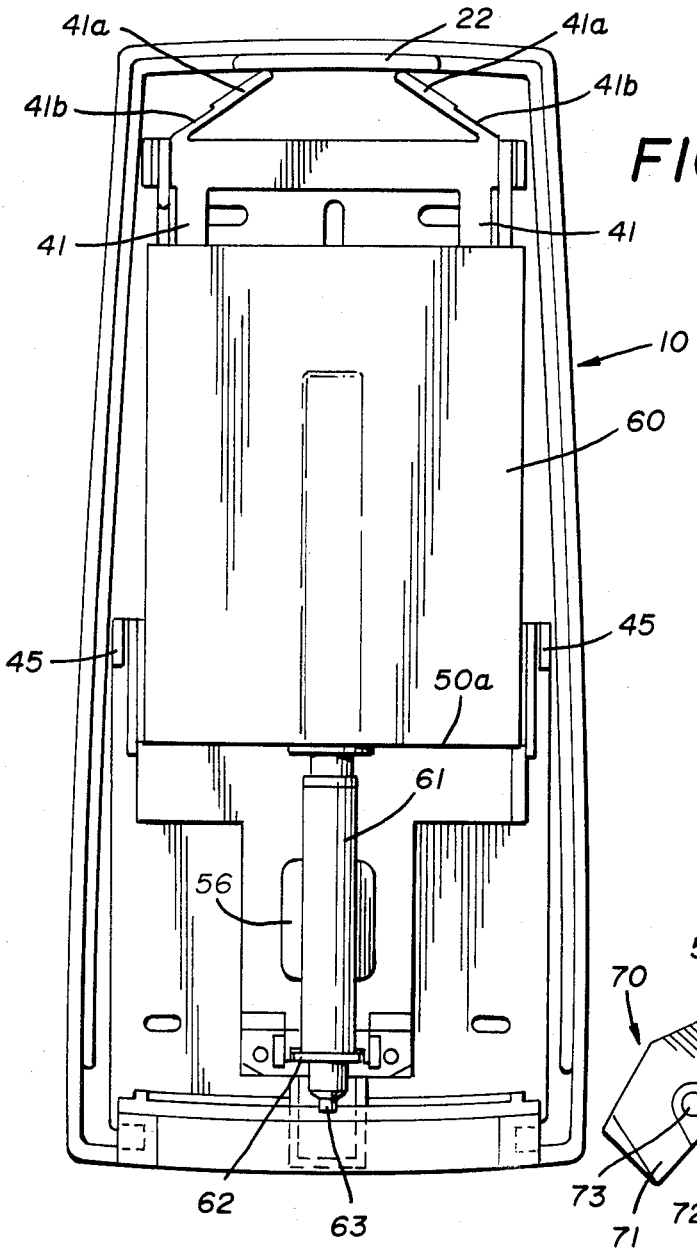
FIG. 4 is a front elevational view with the cover removed and showing the cartridge or container for the soap in place on the back plate.

Cover 30 can then be pivoted to the open position of FIG. 5 and the dispensing unit 70 swung out so that the cartridge 60 can be inserted on shelf 50*a* of support unit 50 as clearly shown in FIGS. 4 and 5 of the drawings. With dispensing unit 70 pivoted out of the way, tube 61 can then be located against the front face of the support unit and fitting 62 can be seated in fitting 55. Cover 30 can then be closed and the dispensing bar of dispensing member 70 will be accessible through aperture 35*a* of the cover and the end of tube 61 will be accessible through aperture 34*a* in bottom wall 34 of the cover. It will be noted that during the closing operation, the cam surfaces 38,38 on cover 30 will engage dispensing unit 70 and force it into engagement with the tube 61.

Further pressure on the dispensing bar portion of the body 71 will collapse the tube still further against back up block 56 on the forward wall 51, force material out through the dispensing nozzle and into the hand of the user.

In this regard, the pressure member 72 normally partially collapses tube 61. When dispensing unit 70 is moved further toward back plate 20, the tube is further collapsible and the material between the corner 72*a* of member 72 and the nozzle 63 will be dispensed as the face of pressure member 72 engages the tube. In effect, the member 72 performs a rolling action on the tube to unseat the ball 81 of no-drip valve 80 and expel the material.

When pressure is released, the no-drip valve 80 closes under pressure of spring 82 and the vacuum formed in tube 61 will draw another charge of material into the tube.

As noted earlier, the back plate 20 is intended to be mounted on a vertical surface, such as a wall, by adhesive, screws, hooks, or other suitable mounting means. It will be noted that the dispensing pressure is applied toward the back plate thereby actually reinforcing the mounting engagement with each operation and eliminating a common problem of separation from the mounting surface.

While a full and complete description of the invention has been set forth in accordance with the dictates of the Patent Statutes, it should be understood that modifications can be resorted to without departing from the spirit hereof or the scope of the appended claims.

What is claimed is:

1. A dispenser for dispensing viscous material from a container having an elongate, flexible dispensing tube, comprising:

(A) a body;

(B) a cover attached to said body and movable between open and closed positions;

(C) means, carried by said body, for supporting the container and locating the dispensing tube in dispensing condition;

(D) said body having a mounting portion for attachment to a vertical surface;

(E) pressure means carried by said body and urged into engagement with the tube by movement of the cover to said closed position and being further movable into collapsing and dispensing engagement with the tube;

(F) said pressure means being movable toward said mounting portion of said body to collapse the tube and dispense the material;

(G) locking means carried by said body for movement into and out of locking engagement with said cover; and (H) said locking means being releasably attached to said body.

2. The dispenser of claim 1 wherein said locking means include an actuating extension; said cover being dimensioned so as to overlie and conceal said actuating extension when in closed position; and said actuating extension being accessible when said cover is in closed position.

3. The dispenser of claim 1 wherein said body has upper and lower edges; and said locking means are accessible from said lower edge of said body and include resilient means engaging said upper edge of said body and ormally urging said locking means toward said lower edge of said body and into locking engagement with said cover.

4. The dispenser of claim 3 wherein said resilient means are integral with said locking means.

5. The dispenser of claim 1 wherein said locking means include (A) a plate releasably held against one face of said body for sliding movement relatively thereof;

(B) a plurality of hooks projecting from said plate; and (C) a plurality of clips carried by said cover for selective engagement and disengagement with said hooks upon movement of said plate relatively of said body.

6. The dispenser of claim 5 wherein said clips are removably carried by said body.

7. The dispenser of claim 5 wherein said body has upper and lower edges; and said plate includes integral resilient means for engaging said upper edge of said body and ormally urging said hooks toward said lower edge of said body and into engagement with said clips.

8. The dispenser of claim 5 wherein said plate includes means for limiting the extent of its travel relatively of said body.

9. The dispenser of claim 5 wherein said body includes spaced elongate rails; and said plate is releasably trapped between said rails.

10. The dispenser of claim 1 wherein said pressure means include spring means normally urging said pressure means into partially collapsing engagement with the tube.

11. The dispenser of claim 1 wherein said pressure means include (A) a housing pivotally mounted on said body and movable into and out of covering relationship with the tube;

(B) a pressure member pivotally mounted on said housing; and (C) spring means normally urging said pressure member into engagement with the tube when said cover is in closed position.

12. The dispenser of claim 11 wherein said cover has an opening disposed adjacent said housing when in closed position and dimensioned so as to engage a portion of said housing while leaving a portion thereof accessible from the exterior of said housing.

13. The dispenser of claim 12 wherein cam surfaces are disposed on said cover for engagement with said housing during movement of said cover from open to closed position to move said pressure member into engagement with the tube.

14. The dispenser of claim 1 wherein a locating fitting is carried by the projecting end of the tube; and a complemental fitting is releasably carried by said body for releasable engagement with said locating fitting of the tube.

15. A dispenser for dispensing viscous material from a container having an elongate, flexible dispensing tube, comprising:

(A) a back plate;

(B) a cover, hingedly connected to said back plate and movable between open and closed positions with respect thereto;

(C) latch means carried by said back plate and said cover for releasably securing said cover in its closed position;

(D) a tube receiving member carried by and projecting from one face of said back plate;

(E) a pressure member hingedly mounted on said back plate;

(F) said pressure member being urged into engagement with the tube by said cover when the tube is held in said tube receiving member and said cover is moved to its closed position and being movable away from said back plate when said cover is in its open position;

(H) said cover having (1) top and bottom walls, (2) opposed side walls interconnecting said top and bottom walls, and (3) a front wall interconnecting said top and bottom walls and said side walls;

(I) said front wall having a through opening therein slightly larger than said pressure member (1) whereby said pressure member is accessible when said cover is in closed position; and (J) said bottom wall having a through opening therein for access to the tube when said cover is in closed position.

16. The dispenser of claim 15 wherein said latch means are removably mounted on said back plate.

17. The dispenser of claim 15 wherein said back plate is adapted for mounting on a vertical surface; and said pressure member is movable toward said back plate for dispensing engagement with the tube.

* * * * *